United States Patent [19]

Daniels et al.

[11] Patent Number: 4,457,980

[45] Date of Patent: Jul. 3, 1984

[54] TEXTILE FABRICS WITH OPAQUE PIGMENT PRINTING AND METHOD OF PRODUCING SAME

[75] Inventors: John Y. Daniels, Pineville, N.C.; James C. Stevenson, Fort Mill, S.C.

[73] Assignee: Springs Industries, Inc., Fort Mill, S.C.

[21] Appl. No.: 429,794

[22] Filed: Sep. 30, 1982

Related U.S. Application Data

[63] Continuation-in-part of Ser. No. 294,782, Aug. 20, 1981, abandoned.

[51] Int. Cl.[3] ..... B32B 3/00

[52] U.S. Cl. ..... 428/196; 427/282; 427/288; 427/389.9; 428/206; 428/207; 428/240; 428/244; 428/324; 428/325; 428/329; 428/331; 523/222

[58] Field of Search ..... 428/196, 206, 207, 240, 428/244, 199; 427/282, 288, 389.9; 524/558, 560, 561, 562, 563, 564, 565, 566, 567, 568, 548, 575; 523/222

[56] References Cited

U.S. PATENT DOCUMENTS

| | | | |
|---|---|---|---|
| 2,310,436 | 2/1943 | Johnson | 8/14 |
| 3,441,427 | 4/1969 | Skofroneck | 427/288 |
| 3,443,979 | 5/1969 | Skofroneck | 427/288 |
| 3,948,597 | 4/1976 | Sakaoka | 8/14 |
| 4,031,280 | 6/1977 | Weller et al. | 428/196 |
| 4,280,888 | 7/1981 | Buch et al. | 428/207 |
| 4,283,452 | 8/1981 | Marco | 428/206 |
| 4,315,790 | 2/1982 | Rattie et al. | 428/207 |
| 4,351,871 | 9/1982 | Lewis et al. | 428/196 |

FOREIGN PATENT DOCUMENTS

| | | |
|---|---|---|
| 1107636 | 5/1961 | Fed. Rep. of Germany . |
| 1444060 | 12/1968 | Fed. Rep. of Germany . |
| 1593299 | 7/1970 | France . |
| 2402733 | 4/1979 | France . |
| 589782 | 6/1947 | United Kingdom . |
| 926283 | 5/1963 | United Kingdom . |
| 929451 | 6/1963 | United Kingdom . |
| 954587 | 4/1964 | United Kingdom . |
| 954588 | 4/1964 | United Kingdom . |
| 954589 | 4/1964 | United Kingdom . |
| 1433609 | 4/1976 | United Kingdom . |
| 1514504 | 6/1978 | United Kingdom . |

*Primary Examiner*—James J. Bell

*Attorney, Agent, or Firm*—Bell, Seltzer, Park & Gibson

[57] ABSTRACT

Highly opaque printed areas are produced on uncolored or precolored fabrics pursuant to this invention with the use of an aqueous opaque printing paste comprising a dispersion of an opacifying pigment and an aqueous curable latex polymer binder. In accordance with the invention multicolor prints with a variety of unique and visually appealing shade possibilities and color effects not heretofore possible are achieved.

34 Claims, 3 Drawing Figures

TEXTILE FABRICS WITH OPAQUE PIGMENT PRINTING AND METHOD OF PRODUCING SAME

CROSS REFERENCE TO RELATED APPLICATION

This application is a continuation-in-part of commonly owned copending application Ser. No. 294,782 filed Aug. 20, 1981, now abandoned.

FIELD AND BACKGROUND OF THE INVENTION

This invention relates to textile pigment printing, and in particular to the production of a printed textile fabric wherein the printed areas are characterized by being substantially opaque and thus unaffected by the color of the underlying yarns.

Textile pigment printing, by definition, involves the printing of an insoluble coloring material (pigment) on selected areas of a textile fabric. The pigment, which has no affinity for the fibers of the fabric, is adhered to the fabric by a resin binder. The term "resin-bonded pigment" is often applied to this type of textile printing process and product.

In conventional textile pigment printing operations, the pigment colorants and resin binder are in an aqueous emulsion in the form of a thick printing paste, and this printing paste is applied to the fabric by patterned rollers or by screens. After the paste is printed onto the fabric, the fabric is subjected to heat to dry and cure the resin binder.

In conventional resin-bonded pigment prints of this type, the printed areas are relatively transparent. While the pigments serve to color the yarns, the underlying color of the yarn shows through. For this reason, pigment printing is usually done on an uncolored or white fabric. When pigment printing is done on predyed fabrics, it is generally restricted to the printing of darker colors over a lighter background color. Even then, the effect of the background color on the pigment must be taken into account in order to obtain the desired resulting color. For example, the printing of a blue pigment over a yellow background fabric will result in a greenish appearance as a result of the additive effect of the yellow and blue colors. Consequently, only limited colors can be otained by overprinting on predyed fabrics using conventional pigment printing techniques.

Attempts to overcome the effect of the background color by laying down a thicker layer of the aqueous printing paste have been generally unsuccessful. When the printing paste is applied to the fabric in a thick layer sufficient to completely cover and hide the underlying yarns and the fabric is dried and cured, the surface portions of the printed area dry first and form a skin which prevents evaporation of the moisture from the printing paste. This leads to an inadequately cured product or to an unacceptable mud-cracked appearance or both. Such products also have poor washfastness properties.

There are many textile designs and patterns which call for relatively small areas of a lighter color against a darker background color. To produce such patterns by conventional pigment printing techniques has required that both the lighter colored areas and the darker background areas be produced by printing onto an uncolored fabric. Consequently, the entire surface of the fabric is covered with resinbonded pigments. Such fabrics tend to have a relatively stiff, harsh hand and the colorfastness is not as great as in dyed fabrics. While this type of fabric is suitable for certain applications, such as for certain types of upholstery fabrics for example, it has limited applicability in other areas, such as for apparel fabrics, for example.

Because of the limited ability of conventional pigment printing techniques to produce the above-noted types of designs and patterns, a specialized process and apparatus has been developed which is capable of printing very opaque light or dark colors on fabrics, either undyed or predyed. This process and apparatus has been used commercially, for example, for printing a specialty fabric having a pattern of opaque dots resembling the appearance of a Jacquard-woven Swiss dot fabric. This technique utilizes a pigmented solvent-based lacquer, not unlike a paint, which is applied to the fabric in a relatively thick layer with a special type of rotary stencil printing range utilizing a perforated roll having the desired dot pattern. The perforated roll is costly and thus limits the number of patterns which can be produced. Because the printing paste is solvent-based, this process and apparatus requires an explosion-proof curing oven and a relatively expensive solvent recovery system for recovering the volatile solvent and maintaining acceptable air quality standards. To avoid bleeding of the dye from the fabric into the printed area and to assure safety of the process, the fabric must be cured at a relatively low temperature. Consequently, the apparatus has a relatively slow processing speed. Additionally, the apparatus is limited to only a single printing station, thus permitting only a single color to be printed on the fabric. Cleaning of the apparatus is very difficult and time consuming and requires the use of a volatile solvent. In fabrics produced by this process and apparatus, the lacquer dots or printed areas have exhibited a tendency to wear off, or to smear or run when contacted by certain chemicals contained in toiletries. Additionally, if such fabrics are ironed with too hot an iron, the lacquer dots may stick to the iron and/or discolor.

With the foregoing in mind, it is an object of this invention to provide a method for printing very opaque colors on textile fabrics using resin-bonded pigments, and wherein the limitations and disadvantages of conventional pigment printing and the aforementioned lacquer printing techniques are overcome.

It is a further object of this invention to provide a method for producing resin-bonded pigment printed fabrics in a wide variety of patterns and colors not obtainable by the printing techniques heretofore available.

SUMMARY OF THE INVENTION

In accordance with the present invention, these and other objects and advantages are realized by the provision of an aqueous opaque printing paste formulation and method of application as hereinafter more fully described. This printing paste, unlike the aqueous printing pastes used in conventional screen printing operations, has opacity and can be applied over either dark or light background fabrics without being affected by the color of the underlying yarns. Since this printing paste is an aqueous system, it eliminates the problems inherent in the aforementioned lacquer printing techniques due to the presence of a volatile solvent. For example, because the printing paste is nonflammable, the necessity of expensive explosion-proof ovens and solvent reclamation equipment is eliminated. Cleaning of the equipment can be carried out with water rather than solvents, and the cleaning time is a mere fraction of that required in the lacquer printing system. Additionally, and quite surprisingly, the opaque aqueousbased printing paste of this invention requires considerably less pigment add-on to the fabric than that required in the lacquer printing system, thus providing additional cost advantages. Additionally, the fabrics have considerably improved washfastness as compared to fabrics printed with the lacquer process.

In addition to the foregoing advantages, it has been discovered that the aqueous opaque printing paste of this invention is extremely versatile in its manner of application, and can be applied to fabrics not only by existing rotary stencil printing ranges of the type used for printing with lacquer, which run at relatively low speeds and are limited to only one color printing station, but also can be applied to fabrics using rotary screen printing ranges, which run at much higher speeds and have multiple printing stations. Thus, this invention makes it now possible to produce multicolor prints with an infinite number of shade possibilities, patterns, and background colors not heretofore obtainable with existing rotary screen printing or lacquer printing technology.

In this regard, printed textile fabrics in accordance with the present invention are characterized by being formed of interengaged yarns of a predetermined color, with selected areas of the fabric having printed pattern areas of predetermined color contrasting with the color of the yarns, the printed pattern areas being substantially opaque and thus unaffected by the color of the yarns. The printed pattern areas comprise an opaque coating covering the exposed surfaces of the yarns, said coating comprising an opacifying pigment providing opacity in said coating and a cured water insoluble polymer binder affixed to said yarns and bonding said opacifying pigment to the yarns.

The opaque coating which forms the printed pattern areas is characterized by individually coating each of the yarns in the printed area such that the interengaged yarn structure of the fabric is not obliterated, but remains visible. More specifically, the opaque coating is further characterized by individually encapsulating and coating the exposed fibers at the surface of the yarn such that the individual surface fibers of the yarn also are not obliterated and remain visible.

In one aspect of the invention, through the use of a rotary screen printing range or other suitable apparatus for applying a plurality of opaque printing paste colors or shades, a novel class of visually appealing fabrics is produced in which the printed pattern areas are formed of a plurality of colors contrasting with one another and with the predetermined color of the yarns, at least one of the colors being lighter than the color of the yarns. Various other unique patterns and effects can be produced, as will become apparent from the detailed description and examples which follow.

The aqueous opaque printing paste of this invention is comprised of a stable aqueous dispersion of an opacifying pigment and a polymer binder which is capable of being cured to a water insoluble state in which it is affixed to the yarns and serves to bond the opacifying pigment to the yarns. The printing paste may also optionally include relatively smaller amounts of other materials, such as crosslinking agents, thickeners, emulsifiers, pH control agents, and the like. The opacifying pigment and the curable polymer binder are the major constituents, however, and are present in concentrations such as to provide a printing paste with a very high solids content, e.g. preferably greater than about 25 percent total solids, which is considerably higher than conventional aqueous printing pastes. The printing paste desirably comprises at least about 20 percent by weight pigment (solids basis) and at least about 5 percent by weight polymer binder (solids basis). This combination of pigment and polymer binder is applied to the fabric in an amount sufficient to form in the dried and cured fabric a highly opaque coating which covers the exposed surface of the yarns of the fabric, thereby completely hiding the underlying color of the yarns. The aqueous printing paste formulation of the invention, by individually coating each yarn, penetrates into the fabric and is generally visible on both the front and reverse sides thereof. This penetration into the fabric and the individual coating or encapsulation of the yarns provides excellent durability and washfastness properties in the printed fabrics. The porosity, flexibility and tactile properties of the fabric are not adversely affected, and indeed, are considerably better than in the printed areas obtained by the aforementioned conventional pigment printing and solvent-based lacquer printing techniques of the prior art. Printed areas produced by these techniques, in contrast to the printed areas produced pursuant to the invention, are characterized by forming a skin or coating which tends to remain on the surface of the fabric and is thus subject to abrasion and wear.

BRIEF DESCRIPTION OF THE DRAWINGS

Some of the features and advantages of the invention having been stated, others will become apparent from the detailed description and examples which follow, and from the accompanying drawings, in which—

DETAILED DESCRIPTION

Figure 1:
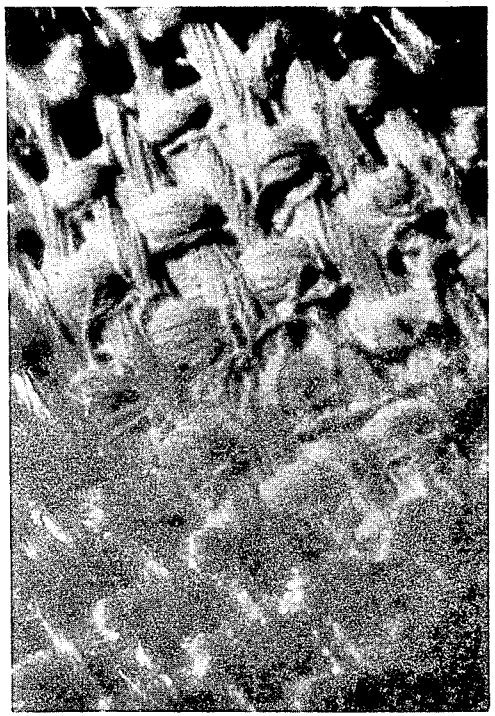
FIG. 1 is a photomicrograph showing a woven fabric with an opaque printed area thereon produced in accordance with this invention; and, FIGS. 2 and 3, for purposes of comparison, are photomicrographs showing a similar fabric with an opaque printed area thereon produced, respectively, by a commercially practiced aqueous printing technique, and by solventbased laquer printing techniques known in the art.

The aqueous opaque printing paste of the present invention has a relatively high solids content, e.g. preferably at least 25 percent total solids, and consists mainly of an opacifying pigment and a curable polymer binder mixed therewith to form a stable aqueous dispersion.

To serve as an opacifying pigment for purposes of this invention, the material must be highly opaque, have color properties which permit it to be used alone or mixed with other colorants, such as colored pigments, and it must be readily dispersable at relatively high concentrations in the aqueous binder system. There are many commercially available materials having these characteristics. Where it is desired to provide a white or relatively light colored printed area, particularly against a relatively darker background color, the preferred opacifying pigment for use in the printing paste formulation of this invention is a white pigment. One particular white pigment which has been found to be especially suitable because of its bright white appearance, cost and availability is titanium dioxide. Other suitable white pigments include silicates, aluminum compounds, calcium carbonate, and the like. The white opacifying pigment is used as the sole pigment when an opaque white printed area is desired. When opaque colored printed areas are desired, appropriate colorants, such as colored pigments are additionally included in the aqueous printing paste. In order to achieve high chroma (color saturation) with certain hues, one or more opacifying pigments of lesser whiteness or of intermediate shades may be employed, either alone or in combination with white pigments.

In addition to the white opacifying pigments noted above, examples of other compounds suitable for use as opacifying pigments in the present invention include the following: zinc oxide, zinc sulfide, lithopone ($ZnS/BaSO_4$), basic carbonate white lead, basic sulfate white lead, lead oxide (lead dioxide), calcium sulfate, barium sulfate, silica, clay ($Al_2O_3.2SiO_2.2H_2O$), lead sulfate, magnesium silicate, mica, wollastonite ($CaSiO_3$), aluminum hydrate, magnesium oxide, magnesium carbonate, aluminum oxide, ferric oxide, sodium carbonate, strontium sulfide, calcium sulfide, barium carbonate, antimonius oxide, zirconium white, barium tungstate, bismuth oxychloride, tin white, lead silicate, chalk, bentonite, barium sulfate, gloss white, gypsum, zinc phosphate, lead phosphate, and calcium silicate. For the printing of relatively dark colors, carbon black may be used as an opacifying pigment instead of a white pigment.

The use of an opacifying pigment, particularly a white opacifying pigment, and the printing thereof against a darker background color, are features which clearly distinguish this invention over conventional pigment printing techniques. In conventional pigment printing, white pigments are used only on a white background fabric for achieving a "white-on-white" effect. White pigment printing pastes are not generally applied to darker background colors, since such printing pastes would not provide adequate contrast against the darker background color.

The amount of the opacifying pigment used in the printing paste formulation of this invention is considerably greater than the amount of pigment used in conventional aqueous-based printing pastes, and is typically considerably greater than the total solids content of the polymer binder. In a preferred formulation, the printing paste comprises at least 20 weight percent opacifying pigment (solids basis) and at least 5 weight percent polymer binder (solids basis).

The polymer binder for the opacifying pigment must be capable of application in an aqueous system, form a stable dispersion with the insoluble opacifying pigments and other additives in the binder system, have good film- forming properties when applied to the fabric, and must be capable of being dried and cured to a water insoluble state imparting good washfastness and abrasion resistance properties to the printed pattern. The polymer binder may be suitably applied as an aqueous solution or as an aqueous dispersion or latex. The drying and curing of the print paste may be accomplished by suitable means, such as by heating, and various mechanisms may be employed for curing the binder, i.e., converting the polymer binder from an aqueous solution or dispersion as it is applied to a water insoluble state in the final product. For example, the curing may involve the reacting or splitting off of water solubilizing groups, such as carboxyls, condensation or addition polymerization, radiation curing or crosslinking.

One example of a particularly suitable curable polymer binder system for the opacifying pigment is an aqueous film-forming crosslinkable latex. The latex composition suitable for use in the present invention is a stable dispersion of polymers and/or copolymers in water which will effectively maintain the pigment in uniform suspension, and when printed onto the fabric, will coat the yarns of the fabric with a thin film of the latex and pigment. Upon heating, the latex film dries and cures, with a crosslinking reaction taking place between the reactive side groups of the polymer chains. There is thus formed a tough, flexible, water-insoluble pigmented opaque film around the yarns in the areas of the fabric where the printing paste is applied. If the particular latex polymer used is not itself heat reactive, then suitable catalysts or curing agents are added to promote curing and crosslinking upon heating.

A preferred class of film-forming aqueous latex for use with this invention are acrylic latexes. These are aqueous, anionic, colloidal dispersions of acrylate polymers and copolymers. An example of suitable commercially available acrylic latexes is the Hycar series of acrylic latexes available from B. F. Goodrich Company. Other heat reactive film-forming aqueous latexes suitable for use in the present invention include styrene-butadiene latexes, polyvinyl chloride and polyvinylidene chloride latexes, polyvinyl pyrimidine latexes, and polyacrylonitrile latexes.

To provide enhanced abrasion resistance and washfastness, a heat reactive crosslinking agent capable of crosslinking with the latex may optionally be included in the binder system. The crosslinking agent serves to reinforce the cured latex structure and thereby provide enhanced wet abrasion resistance and washfastness properties to the printed area. The crosslinking agent is a compound or resin (polymer) having functional groups capable of reacting with reactive sites on the latex under curing conditions to thereby produce a crosslinked structure. Examples of reactive chemical compounds suitable as crosslinking agents include aldehydes and dialdehydes such as formaldehyde and glyoxal. Examples of reactive thermoplastic or thermosetting resins suitable as crosslinking agents include glyoxal resins, melamines, triazones, urons, carbamates, acrylamides, and silicone resins. One particularly suitable type of heat reactive crosslinking resin is a melamineformaldehyde condensation product, one example of which is AEROTEX RESIN MW, produced by American Cyanamid Company.

The polymer binder system may also suitably employ polymers which are not themselves crosslinking and to which additional crosslinking agents are not added. Suitable nonreactive polymeric resins of this type may for example, be based on polyvinyl chloride or polyvinylidene chloride, such as the Geon series of resins available from B. F. Goodrich. Other suitable nonreactive resins include polyester resins, polysiloxane resins, polyvinyl alcohol and polyvinyl acetate. Instead of forming crosslinks, these resins, upon curing, fuse together the individual polymer particles to form individual polymer particles to form entangled polymer chains with good adhesive properties. The polymeric material selected may be applied either as a suspension, an emulsion or in solution.

Silicone fluids and elastomers may be incorporated into the printing paste to aid in obtaining a smooth application of the pigment to the fabric. The use of silicone polymers has been found to provide dots or designs free of rough edges and crack marks. Silicone resin polymers may also be employed as a substitute for or in addition to the thermoplastic or thermosetting resins.

Conventional thickeners may also be utilized to control the viscosity and rheology of the paste, depending upon the size and design of the print pattern and the running speed of the print screen.

The paste may also contain other conventional additives, such as emulsifers, antifoam agents, and pH control agents. It is important that the printing paste have good wetting and film-forming properties so that when applied to the fabric, it will penetrate and coat the individual yarns of the fabric rather than remaining on the surface of the fabric. If these properties are not adequately presented by the polymer binder itself, suitable wetting agents or emulsifiers may be included.

The printing paste may be applied either to uncolored (e.g. white) fabrics or to precolored fabrics, the precolored fabrics being of a predetermined color throughout and produced by any suitable method such as by piece dyeing, yarn dyeing or by pigment padding, for example.

The particular rate of application of the printing paste to the fabric will vary depending upon various factors, including fabric weight and construction, color of the fabric, and printing color.

Drying and curing of the printing paste may be carried out under conditions of temperature and time conventional for the particular manner of application. For rotary screen printing, for example, drying and curing may be carried out at temperatures of 250 to 400 degrees F. for from several seconds up to several minutes. Energy savings and improved fabric properties may be realized by curing at lower temperatures, with the selection of a suitable low temperature curing polymer binder. For curing at low temperature, it may be desirable to include a crosslinking catalyst. The particular catalyst chosen would depend upon its compatibility with the crosslinking resin, the polymer binder, and the other components in the paste. Many latex and resin emulsions are known to precipitate in solution in the presence of acid catalysts and catalysts containing polyvalent ions such as are found in metallic and organometallic catalysts such as magnesium chloride. One class of catalyst which has been particularly useful for low temperature curing is an ammonium capped sulfonic acid catalyst such as Quickset P. This catalyst is mildly acidic and does not disrupt the mildly alkaline pH for the latex mix in the quantities used. On curing, the ammonia is released, leaving the sulfonic acid group, which causes the pH to become acidic and providing an acid catalyst for the system. The catalyst would then behave as a conventional methane sulfonic acid or p-toluene sulfonic acid catalyst.

When the fabric is cured and dried, the areas printed with the printing paste are characterized by having a thin flexible opaque coating covering the exposed surfaces of the yarn and thus hiding from view the underlying color of the yarn. The coating consists predominantly of the opacifying pigment bonded securely to the yarns by the cured water insoluble polymer binder.

The photomicrograph of FIG. 1 clearly illustrates the structure of the opaque coating produced by the printing paste of the invention. The pigmented opaque coating is characterized by penetrating each yarn and individually encapsulating and coating the exposed fibers at the surface of the yarn. However, the fabric structure defined by the interwoven yarns is not obliterated by the coating and remains clearly visible. Further, the individual surface fibers of the yarns also remain visible, indicating that the coating has penetrated into the yarn rather than remaining on the surface of the fabric or on the outer surface of the individual yarns. The completeness and the opacity of the coating is also evident from the contrast in appearance between the printed areas and the adjacent nonprinted areas; a flat or dull appearance being exhibited by the opaque coating in printed areas in contrast to the luster of the uncoated fibers in the nonprinted areas.

Figure 2:
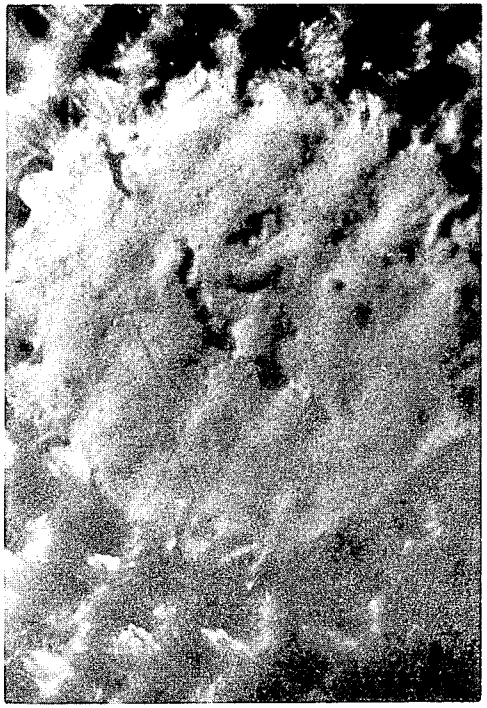

FIG. 2 shows a printed area produced by a commercially practiced printing technique in which an aqueous printing paste is applied to the fabric in a very thick layer in an effort to achieve the desired opacity. As is evident from the photomicrograph, the printing paste has dried and cured to form a "skin" which has remained on the surface of the fabric rather than penetrating into the fabric. The woven structure of the fabric is obliterated and hidden from view by the thick skin-like deposit. The photomicrograph reveals evidence of crusting over during drying and curing, giving a "mud-cracked" appearance. These printed areas exhibit poor abrasion resistance and washfastness properties.

Figure 3:
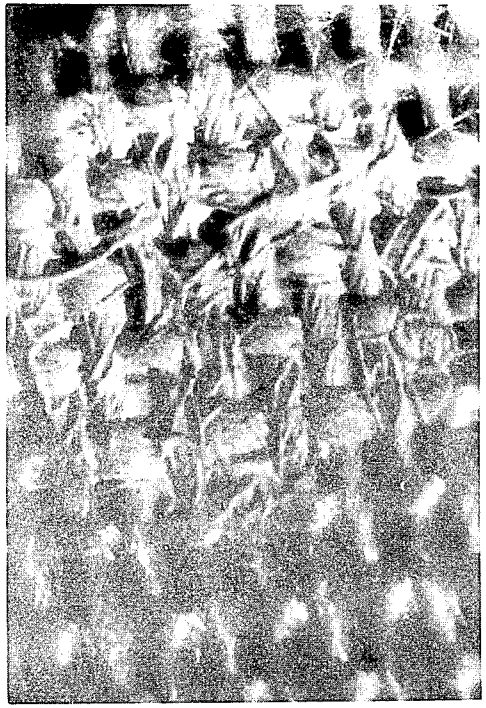

FIG. 3 shows a printed area produced from a solvent-based lacquer printing formulation. The printed areas exhibit a glossy appearance indicative of the lacquer composition. While the formulation has penetrated the fabric to some extent, such that woven fabric structure is not completely obliterated, a significant proportion of the composition remains on the surface of the fabric and in the outermost portions of the individual yarns, such that in many areas the individual fibers at the outer surface of the yarns are hidden from view by the coating.

The following examples are given for purposes of illustrating the invention and how to practice the same. These examples are not intended to be understood as limiting the scope of the invention. All parts, percentages and ratios are by weight, unless otherwise indicated.

WHITE OPAQUE PRINTING

EXAMPLE 1

A white printing paste was prepared having the following formulation:

| | Percent of Total Composition |
|---|---|
| Pioneer White Pigment<br>Pioneer Chemicals | 50 |
| Hycar 2679 Latex<br>B. F. Goodrich | 16 |
| Acrysol TT-678<br>Rohm & Haas | 9 |
| Aerotex Resin MW<br>American Cyanamid | 6.8 |
| Experimental Thickener E1615<br>Rohm & Haas | 5 |
| Quickset P<br>CNC Chemical Corporation | 2.2 |
| Antifoam B Emulsion<br>Dow Corning | .2 |
| Water | 10.8 |

A commercially available rotary stencil printing range normally used for lacquer dot printing was utilized for printing a polyester/cotton blend of print cloth fabric with a dot pattern of the above aqueous print paste formulation. The fabric was thereafter cured at 260 degrees F. for ten minutes. The printed fabric had sharply defined dots of good opacity. Wash tests indicated very good durability.

EXAMPLE 2

The following white print paste formulation was prepared:

| | Percent of Total Composition |
|---|---|
| Pioneer White BS Pigment | 75.0 |
| Pioneer Chemicals | |
| Hycar 2679 Latex | 17.0 |
| B. F. Goodrich | |
| Aerotex Resin MW | 3.4 |
| American Cyanamid | |
| Quickset P | .85 |
| CNC Chemical Corporation | |
| Emulsifier 1535 | .5 |
| Thickener E 1615 | 1.05 |
| Rohm & Haas | |
| Ammonia | .425 |
| Water | 1.425 |

This printing paste had a total solids content of about 43 percent of which about 31 percent was pigment and about 8 percent was latex.

A rotary screen printing range was utilized for printing the above formulation in a dot pattern onto a white polyester/cotton woven print cloth, and onto similar fabrics which had been piece dyed the following colors: pimento, green, cream, and pink. The fabrics were cured at 350 degrees F. for 90 seconds. The dot patterns were sharply defined and of pure white color, even on the darker ground shades.

EXAMPLE 3

The following white print paste formulation was prepared:

| | Percent of Total Composition |
|---|---|
| Pioneer White BS Pigment (Titanium Dioxide Dispersion) | 75.0 |
| Hycar 2679 Latex | 15.4 |
| Propylene Glycol | 3.1 |
| Varsol | 3.1 |
| Blockout B (Aluminum Silicate Dispersion) | 13.1 |
| Resin MW | 4.6 |
| Ammonia | .8 |
| Quickset P. | .9 |
| Thickner Concentrate T | 1.5 |

This printing paste is printed onto fabric with a rotary screen printing range and dried and cured as in Example 2.

COLORED OPAQUE PRINTING

The above examples illustrate aqueous print paste formulations useful for printing opaque white patterns on uncolored or predyed fabrics. In these applications, the white opacifying pigment also serves to provide the desired white color. Where colored opaque areas are to be printed, the appropriate colored pigment or pigments may be used in combination with the opaque print paste formulation. In this instance the pigment serves as an opacity builder and the colored pigments provide the desired color. In formulating a colored printing paste, white printing paste formulations similar to Examples 1 or 2 may be conveniently used as the starting material. To this is added the appropriate colored pigments. The amount of colored pigment used depends upon, the shade desired. For darker shades, the amount of colored pigment used may equal or exceed the amount of white print paste. Additional aqueous crosslinkable latex polymer is also added to serve as a vehicle for the pigment in the paste and as a binder in the cured state. On white or light colored ground shades a clear print paste thickener, referred to in the trade as "clear concentrate", may also be added to the paste to allow a reduction in opacity which is not needed in the lighter colored ground shades.

In the colored print paste formulations, as in the white formulations, the preferred binder consists mainly of aqueous film-forming crosslinkable latex, with a minor addition of a heat curable crosslinking resin for enhanced washfastness and durability. The following example describes a suitable aqueous opaque colored print paste formulation:

EXAMPLE 4

A red print paste was produced of the following formulation:

| | Percent of Total Composition |
|---|---|
| Uniprint Scarlet NDL | 23.1 |
| Ultrabond Red 2B | 5.4 |
| Rotary White Formulation of Example 2 | 17.8 |
| Hycar 2679 Acrylic Latex | 17.8 |
| Clear Concentrate | 35.8 |
| Uniprint Concentrate HP | |
| Union Color and Chemical | |

A rotary screen printing range was used to print a pattern of red dots of the above printing paste formulation onto a white print cloth and piece dyed print cloths of various ground shades.

MULTICOLOR OPAQUE PRINTING

Because of the excellent opacity of the aqueous printing paste formulations of the present invention, which permits printing vivid contrasting colors on predyed fabrics of any desired color, and the fact that the printing paste formulations of this invention can be readily applied on conventional rotary screen printing equipment, the present invention makes it possible to produce a variety of colors and patterns not heretofore possible. Thus, one additional aspect of the present invention is the production of a printed textile fabric formed of precolored, and in particular dyed yarns of a predetermined color, selected areas of the fabric having printed pattern areas of predetermined color contrasting with the color of the yarns, the printed pattern areas being substantially opaque and thus unaffected by the color of the yarns, and the pattern areas being formed of a plurality of colors contrasting with one another and with said predetermined color of the yarns, at least one of the colors being lighter than said predetermined color dyed yarns, and said pattern areas comprising a filmlike coating covering the exposed surfaces of the yarns, said coating comprising an opacifying pigment providing opacity in said coating and a thermosetting crosslinked latex polymer binder securely bonding said opacifying pigment to the yarns. One such multicolored fabric is described in the following example:

EXAMPLE 5

Printing pastes of five different colors were produced using a formulation similar to that in Example 4 but varying the colored pigment. The colors were green, yellow, light blue, melon, and royal blue. These printing pastes were used at successive printing stations of a rotary screen printing range for producing a multicolor floral and dot pattern. Piece dyed fabrics of navy, royal blue and bright red were printed with the above multicolor floral and dot pattern. In each sample, the five printed colors contrasted vividly with one another and with the background color of the fabric.

The following examples illustrate the effect of curing temperature, latex concentration, catalyst, and cross-linking resin on the durability and washfastness of the fabric:

EXAMPLE 6

Red piece dyed fabric test specimens were printed with an opaque white printing paste formulation basically similar to that of Example 2, but with varying levels of latex ranging from 0–30% by weight (0 –15 % by weight based on the solids content of the latex). Test specimens of each printing paste formulation were cured at 160 degrees F. for 10 minutes and at 360 degrees F. for 90 seconds. The specimens were then subjected to a standard AATCC washfastness test simulating five commercial launderings (AATCC Test Method 61-1980 Test No. III-A), and thereafter inspected and rated for washfastness on an arbitrary scale of 0 –5 where 0 represents zero washfastness (no printed pattern remaining on the fabric) and 5 represents complete washfastness (no noticeable loss of pattern after washing). The results are presented in Table 1:

TABLE I

| Amount of Latex (Percent solids basis) | Washfastness rating 160° 10 min. | 360° 90 sec. |
|---|---|---|
| 0 | 0 | 0 |
| 1.5 | 0 | 1 |
| 3 | 1 | 2 |
| 5 | 1 | 4+ |
| 7 | 1 | 5 |
| 9 | 4 | 5 |
| 15 | 5 | 5 |

From 0 to 1.5 percent latex showed no washfastness at the lower curing temperature, and only poor washfastness at the higher temperature. At 3 percent latex, the washfastness is still rather poor for both curing temperatures. Good washfastness is observed at the 5 percent level for the higher temperature curing and at the 9 percent level for the lower curing temperature.

EXAMPLE 7

Fabric test specimens similar to those used in Example 6 were printed with a white printing paste formulation similar to that of Example 2, but with the concentration of the AEROTEX resin at levels of 0, 2, 4, 8 and 16 percent. The specimens were dried, cured and tested as in the previous Example. At the lower curing temperature, none of the samples yielded acceptable washfastness, although a slight improvement in fastness was observed at the 8 percent resin level. Samples cured at 360° F. exhibited a fair degree of fastness with no resin added at all. Optimum fastness was achieved at the 4 percent level, with further additions to that level yielding no further improvement, and with slightly less fastness at the 16 percent level.

These tests show that the presence of resin is helpful in improving washfastness, but that the resin is not really essential for achieving washfastness, especially at higher curing temperatures.

EXAMPLE 8

Fabric test specimens were prepared and tested as in the previous examples using a white printing paste formulation similar to that of Example 2 but with varying concentrations of Quickset P catalyst as follows: 0, 0.2.1, 2 and 5 percent.

At the lower curing temperature, no definite pattern in the fastness properties was observed as the catalyst level is increased. For the higher temperature cured prints, no additional fastness is observed above the one percent level.

The following examples illustrate various noncross-linking polymer binder systems which may be employed to produce the opaque prints of this invention.

EXAMPLE 9

Nonreactive Polyvinylchloride Latex

| Nonreactive Polyvinylchloride Latex | Percent |
|---|---|
| Pioneer White BS | 60 |
| Propylene Glycol | 3 |
| Blockout B | 15 |
| Ammonia | 1 |
| Geon ® Latex 460-6 | 20 |
| Thickener Concentrate T | 1 |

This mix is printed and thermally cured in the manner described in Example 1.

EXAMPLE 10

| | Percent |
|---|---|
| Pioneer White BS | 60 |
| Propylene Glycol | 3 |
| Blockout B | 15 |
| Polyvinyl Alcohol (15% aqueous solution) | 20 |
| Ammonia | 1 |
| Thickener Concentrate T | 1 |

This sytem incorporates a water soluble binding system using polyvinyl alcohol. This system may be printed and cured in the manner described in Example 1. A subsequent treatment through a mild solution of sodium hydroxide followed by steaming and washing will yield improved permanence due to decreased solubility of the polyvinyl alcohol.

EXAMPLE 11

| | Percent |
|---|---|
| Pioneer White BS | 60 |
| Propylene Glycol | 3 |
| Blockout B | 10 |
| Eastman Size WD | 25 |
| Ammonia | 1 |
| Thickener Concentrate T | 1 |

This noncrosslinking binding system incorporates water dispersable polyester size, Eastman WD. Improved durability is achieved by processing the printed and cured fabric through a mild caustic solution followed by steaming to insolubilize the sizing compound.

In the drawings and specification, there has been set forth a preferred embodiment of the invention, and although specific terms are employed, they are used in a generic and descriptive sense only and not for purposes of limitation.

That which is claimed is:

1. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque coating covering the exposed surfaces of the intergaged yarns and hiding the underlying color of the yarns, and being further characterized by penetrating into the fabric to the back side thereof and individually coating each of the yarns in the printed area such that the interengaged yarn structure of the fabric remains visible, said coating comprising an opacifying pigment providing opacity in said coating and cured water insoluble polymer binder affixed to said yarns and bonding said opacifying pigment to the yarns.

2. A printed textile fabric as set forth in claim 1 wherein said opaque coating is further characterized by individually encapsulating and coating the exposed fibers at the surface of the yarn such that the individual surface fibers of the yarn remain visible.

3. A printed textile fabric as set forth in claim 1 wherein said opacifying pigment comprises a white pigment.

4. A printed textile fabric as set forth in claim 3 wherein said coating additionally includes colored pigments for providing a predetermined desired color to the printed pattern areas.

5. A printed textile fabric as set forth in claim 1 wherein said printed pattern areas are formed of a plurality of colors contrasting with one another and with said predetermined color of the yarns, at least one of the colors of the printed pattern areas being lighter than said predetermined color of said yarns.

6. A printed textile fabric as set forth in claim 1 wherein said polymer binder comprises a crosslinked latex.

7. A printed textile fabric as set forth in claim 1 wherein said coating additionally includes a heat reactive crosslinking agent crosslinked with said polymer binder.

8. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque coating covering the exposed surfaces of the interengaged yarns and bonded thereto and hiding the underlying color of the yarns, said opaque coating comprising an opacifying pigment, a crosslinked acrylic latex polymer, a heat reactive acrylic resin crosslinked with said acrylic latex polymer, and a curing catalyst.

9. A printed textile fabric as set forth in claim 8 wherein the amount of said opacifying pigment in said coating is greater than the combined amount of said acrylic latex polymer and said acrylic resin.

10. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque coating covering the exposed surfaces of the interengaged yarns and hiding the underlying color of the yarns, and being further characterized by penetrating into the fabric to the back side thereof and individually coating each of the yarns in the printed area such that the interengaged yarn structure of the fabric remains visible, said coating comprising an opacifying pigment providing opacity in said coating and a crosslinked latex polymer binder bonding said opacifying pigment to the yarns.

11. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque pigmented coating bonded to the interengaged yarns and hiding the underlying color thereof, said pigmented coating penetrating each yarn and individually encapsulating and coating the exposed fibers at the surface of the yarn while allowing the interengaged yarn structure of the fabric as well as the individual surface fibers of the yarn to remain visible in the printed pattern areas.

12. A printed textile fabric formed of precolored yarns of a predetermined relatively dark color, selected areas of said fabric having printed pattern areas of predetermined relatively lighter color contrasting with the darker color of the yarns, said printed pattern areas being substantially opaque and thus unaffected by the relatively darker color of the yarns, and said pattern areas comprising an opaque coating covering the exposed surfaces of the yarns and hiding the underlying color thereof, and being further characterized by penetrating into the fabric to the back side thereof and individually coating each of the yarns in the printed area such that the interengaged yarn structure of the fabric remains visible, said coating comprising a white opacifying pigment providing opacity in said coating and a crosslinked latex polymer binder bonding said opacifying pigment to the yarns.

13. A printed textile fabric as set forth in claim 12 wherein said printed pattern areas are of a plurality of colors contrasting with one another and each being lighter than and contrasting with the predetermined relatively darker color of said yarns.

14. A printed textile fabric as set forth in claim 13 in which the fabric is a piece-dyed fabric and said precolored yarns comprise dyed yarns of said predetermined relatively dark color throughout the fabric.

15. A printed textile fabric as set forth in claim 14 in which the fabric is a pigment-padded fabric and said precolored yarns comprise resin-bonded pigmented yarns of said predetermined relatively dark color throughout the fabric.

16. A printed textile fabric formed of yarns of a predetermined color, said fabric having printed thereon a pattern of well-defined dots of a predetermined color contrasting with the color of said yarns, said dots being substantially opaque and unaffected by the color of the underlying yarns, and said dots being formed by an opaque coating covering the exposed surfaces of the yarns and hiding the underlying color thereof, and being further characterized by penetrating into the fabric to the back side thereof and individually coating each of the yarns in the printed area such that the interengaged yarn structure of the fabric remains visible, said coating comprising an opacifying pigment providing opacity to the coating and a crosslinked latex polymer binder bonding said opacifying pigment to the yarns.

17. A printed textile fabric formed of dyed yarns of a predetermined color throughout the fabric, selected areas of said fabric having printed pattern areas of selected areas of the fabric having printed pattern areas of predetermined color contrasting with the color of the yarns, the printed pattern areas being substantially opaque and thus unaffected by the color of the yarns, and the pattern areas being formed of a plurlality of colors contrasting with one another and with said predetermined dyed color of the yarns, at least one of the colors being lighter than said predetermined color dyed yarns, and said pattern areas comprising an opaque coating covering the exposed surfaces of the yarns and hiding the underlying color thereof, and being further characterized by penetrating into the fabric to the back side thereof and individually coating each of the yarns in the printed area such that the interengaged yarn structure of the fabric remains visible, said coating comprising an opacifying pigment providing opacity in said coating and a cured water insoluble polymer binder bonding said opacifying pigment to the yarns.

18. A printed textile fabric as set forth in claim 16 or 17 wherein said opaque coating is further characterized by individually encapsulating and coating the exposed fibers at the surface of each yarn such that the detail of the yarn structure remains visible.

19. A printed textile fabric formed of dyed yarns of a predetermined color throughout the fabric, selected areas of the fabric having printed pattern areas of predetermined color contrasting with the color of the yarns, the printed pattern areas being substantially opaque and thus unaffected by the color of the yarns, and the pattern areas being formed of a plurality of colors contrasting with one another and with said predetermined dyed color of the yarns, at least one of the colors being lighter than said predetermined color dyed yarns, and said pattern areas comprising an opaque pigmented coating bonded to the interengaged yarns and hiding the underlying color thereof, said pigmented coating penetrating each yarn and individually encapsulating and coating the exposed fibers at the surface of the yarn while allowing the interengaged yarn structure of the fabric as well as the individual surface fibers of the yarn to remain visible in the printed pattern areas.

20. In the printing of textile fabrics wherein a printing paste containing pigments and a heat curable binder is applied to selected areas of the fabric and the printing paste is thereafter dried and cured, an improved method of obtaining substantially opaque printed areas unaffected by the color of the underlying yarns, said method comprising applying to the fabric a printing paste comprising a stable dispersion of an opacifying pigment and an aqueous, curable polymer binder, said printing paste being applied to the fabric in an amount sufficient to form in the dried and cured fabric an opaque coating penetrating into the fabric to the back side thereof and covering the exposed surfaces of the yarns and hiding the underlying color thereof while allowing the interengaged yarn structure of the fabric to remain visible.

21. The method as set forth in claim 20 wherein the printing paste has a solids content of at least 30 percent by weight.

22. The method as set forth in claim 20 wherein the amount of said opacifying pigment in said printing paste is greater than the total amount of said aqueous curable polymer binder.

23. The method as set forth in claim 20 wherein said printing paste additionally includes a heat reactive crosslinking agent.

24. The method as set forth in claim 20 wherein said opacifying pigment comprises a white pigment.

25. The method as set forth in claim 20 wherein said aqueous printing paste additionally includes colored pigments.

26. The method as set forth in claim 20 wherein said step of applying the aqueous printing paste to the fabric comprises printing the paste onto the fabric at the printing station of rotary stencil printing apparatus.

27. The method as set forth in claim 20 wherein said step of applying the aqueous printing paste to the fabric is carried out with a plurality of colors at successive stations of a rotary screen printing apparatus.

28. The method as set forth in claim 20 wherein said step of applying the aqueous printing paste to the fabric comprises applying the printing paste to a precolored fabric.

29. The method as set forth in claim 28 wherein the precolored fabric is of a relatively dark color and the printing paste is of a contrasting lighter color.

30. The method as set forth in claim 20 wherein said aqueous printing paste additionally comprises a curing catalyst.

31. The method as set forth in claim 30 wherein said curing catalyst comprises a sulfonic acid catalyst.

32. The method as set forth in claim 20 wherein said printing paste is comprised of said opacifying pigment, an aqueous crosslinkable acrylic latex polymer, a heat reactive crosslinkable acrylic resin, and a curing catalyst.

33. In the printing of textile fabrics wherein a printing paste containing pigments and a heat curable binder is applied to selected areas of the fabric and the printing paste is thereafter dried and cured, an improved method of obtaining substantially opaque printed areas unaffected by the color of the underlying yarns, said method comprising applying to a precolored fabric a printing paste comprising a stable dispersion of a white opacifying pigment and an aqueous crosslinkable latex polymer, said printing paste being applied to the fabric in an amount sufficient to form in the dried and cured fabric a film-like opaque coating penetrating into the fabric to the back side thereof and covering the exposed surfaces of the yarns and hiding the underlying color thereof while allowing the interengaged yarn structure of the fabric to remain visible.

34. In the printing of textile fabrics wherein a printing paste containing pigments and a heat curable binder is applied to selected areas of the fabric and the printing paste is thereafter dried and cured, an improved method of obtaining substantially opaque printed areas unaffected by the color of the underlying yarns, said method comprising applying to the fabric a stable dispersion of an aqueous white printing paste having a solids content of at least 30 percent and comprising at least 25 percent of an opacifying pigment and at least 5 percent of an aqueous latex polymer binder, all percentages by weight, solids basis, said printing paste being applied to the fabric in an amount sufficient to form in the dried and cured fabric an opaque coating penetrating into the fabric to the back side thereof and covering the exposed surfaces of the yarns and hiding the underlying color thereof while allowing the interengaged yarn structure of the fabric to remain visible.

* * * * *

UNITED STATES PATENT AND TRADEMARK OFFICE

CERTIFICATE OF CORRECTION

PATENT NO. : 4,457,980

DATED : July 3, 1984

INVENTOR(S) : John Y. Daniels

It is certified that error appears in the above-identified patent and that said Letters Patent is hereby corrected as shown below:

Column 14, line 59 "14" should be -- 13 -- .

Column 15, lines 14-15 delete "selected areas of the fabric having printed pattern areas of"

Column 15, line 19 "plurlality" should be -- plurality -- .

Signed and Sealed this

*Nineteenth* Day of *March 1985*

[SEAL]

*Attest:*

DONALD J. QUIGG

*Attesting Officer* *Acting Commissioner of Patents and Trademarks*